US011627859B2

(12) United States Patent
Kaner et al.

(10) Patent No.: US 11,627,859 B2
(45) Date of Patent: Apr. 18, 2023

(54) SYSTEMS AND METHODS FOR WASH MONITORING

(71) Applicant: WASHGUARD LLC, Hewlett, NY (US)

(72) Inventors: Andrew Kaner, Hewlett, NY (US); Gary Estes, West Babylon, NY (US); Daniel Devore, Aubrun, AL (US); Alan Seiler, Cross River, NY (US)

(73) Assignee: WASHGUARD LLC, Hewlett, NY (US)

( * ) Notice: Subject to any disclaimer, the term of this patent is extended or adjusted under 35 U.S.C. 154(b) by 68 days.

(21) Appl. No.: 17/119,866

(22) Filed: Dec. 11, 2020

(65) Prior Publication Data

US 2022/0183532 A1 Jun. 16, 2022

(51) Int. Cl.
*A47L 15/00* (2006.01)

(52) U.S. Cl.
CPC ..... *A47L 15/0055* (2013.01); *A47L 2401/023* (2013.01); *A47L 2501/26* (2013.01)

(58) Field of Classification Search
CPC . A47L 15/00–508; A47L 2401/02–026; A47L 2401/06
See application file for complete search history.

(56) References Cited

U.S. PATENT DOCUMENTS 5,417,233 A 5/1995 Thomas et al.
6,819,250 B2 11/2004 Nishioka
7,924,424 B2 4/2011 Erickson et al.
2005/0005952 A1* 1/2005 Bashark ..... A47L 15/0023 134/18
2011/0048460 A1* 3/2011 Grull ..... A47L 15/0049 134/57 D
2012/0186614 A1 7/2012 Hockaday et al.
2014/0048139 A1 2/2014 Fisher
2015/0297055 A1* 10/2015 Kullwitz ..... A47L 15/449 134/113
2017/0027410 A1* 2/2017 Stoyanov ..... A47L 15/0055
2020/0008647 A1* 1/2020 Alexander ..... A47L 15/006
2020/0249704 A1* 8/2020 Savini ..... G01F 1/588
2020/0319092 A1* 10/2020 Schenkl ..... G01N 21/31
2020/0325011 A1* 10/2020 Carrer ..... D06F 33/37

* cited by examiner

*Primary Examiner* — Spencer E. Bell
(74) *Attorney, Agent, or Firm* — Loeb & Loeb LLP

(57) ABSTRACT

A wash monitoring system including a water flow meter that transmits water flow readings of flow through a water line, chemical conduits with color sensors on the chemical conduits and configured to transmit color readings of a chemical within the chemical conduits, and chemical flow meters on the chemical conduits that transmit chemical flow readings of flow through the chemical conduits. The system includes a memory containing processor-executable instructions that cause processors to compare the water flow readings with a range of water flow readings, compare the chemical flow readings with a range of chemical flow readings, compare the color readings with a range of color readings associated with each of the one or more chemical conduits, and initiate an alarm if one of the water flow readings, the chemical flow readings, or the color readings are not within the respective ranges of readings.

12 Claims, 4 Drawing Sheets

SYSTEMS AND METHODS FOR WASH MONITORING

TECHNICAL FIELD

The present disclosure relates generally to the field of appliance monitoring and, more specifically, machine washer performance monitoring.

BACKGROUND

For a dishwasher to properly clean and sanitize dishware, glasses, utensils, pots, pans, etc., the proper amounts of washing agents should be used during a cycle. Other types of washers, such as laundry or sanitizing systems, may involve similar considerations. Improper amounts of these cleaning agents and/or wash temperatures may result in dishware or other wash products that are not sufficiently cleaned or sanitized. The improper sanitizing and washing may occur without an operator's knowledge, as some machine washers may provide no indication that anything is wrong. Particularly commercial settings, improper cleaning and sanitizing may result in fines from inspectors, food poisoning, other detrimental health issues related to unclean dishware or other wash products.

SUMMARY

In an embodiment, the disclosure describes a wash-quality monitoring system that may include a housing and one or more processors housed within the housing. The system may include a supply water flow meter configured to be disposed in a supply water line of a wash system. The supply water flow meter may be in communication with the one or more processors and configured to transmit, to the one or more processors, water flow readings of water flow through the supply water line. The system may include one or more chemical conduits disposed within the housing. The one or more chemical conduits may each include a chemical input providing fluid communication into the housing and a chemical output providing fluid communication out of the housing. The system may include at least one color sensor disposed on each of the one or more chemical conduits, each of the at least one color sensor being in communication with the one or more processors and configured to transmit, to the one or more processors, color readings of a chemical disposed within each of the respective one or more chemical conduits. The system may include at least one chemical flow meter disposed on each of the one or more chemical conduits. Each of the at least one chemical flow meter may be in communication with the one or more processors and configured to transmit, to the one or more processors, chemical flow readings of chemical flow through each of the respective one or more chemical conduits. The system may include a memory containing processor-executable instructions that, when executed by the one or more processors, may cause the one or more processors to compare the water flow readings with a predetermined acceptable range of water flow readings associated with the supply water line, compare the chemical flow readings with a predetermined acceptable range of chemical flow readings associated with each of the one or more chemical conduits, compare the color readings with a predetermined acceptable range of color readings associated with each of the one or more chemical conduits, and initiate an alarm if at least one of the water flow readings, the chemical flow readings, or the color readings are not within the respective predetermined acceptable ranges of readings.

In another embodiment, the disclosure describes a wash monitoring device including a housing and a controller housed within the housing. The controller may include a memory and one or more processors. The device may include one or more chemical conduits disposed within the housing, each of the one or more chemical conduits providing fluid communication into and out of the housing. The device may include a color sensor disposed on each of the one or more chemical conduits, each of the color sensors being in communication with the controller and configured to transmit, to the controller, color readings of a chemical disposed within each of the respective one or more chemical conduits. The device may include a chemical flow meter disposed on each of the one or more chemical conduits. Each of the chemical flow meters may be in communication with the controller and configured to transmit, to the controller, chemical flow readings of chemical flow through each of the respective one or more chemical conduits. The device may include a current sensor disposed on a power cable providing power to a wash system. The current sensor may be in communication with the controller and configured to transmit, to the controller, current readings of an electrical current flowing through the power cable. The memory may contain processor-executable instructions that, when executed by the one or more processors, may cause the one or more processors to determine that the wash system has initiated a wash cycle based on a determination that the current running through the power cable exceed a predetermined idle value, based on the determination that the wash system has initiated a wash cycle, compare the chemical flow readings with a predetermined acceptable range of chemical flow readings associated with each of the one or more chemical conduits, based on the determination that the wash system has initiated a wash cycle, compare the color readings with a predetermined acceptable range of color readings associated with each of the one or more chemical conduits, and initiate an alarm if at least one of the chemical flow readings or the color readings are not within the respective predetermined acceptable ranges of readings.

In another embodiment, the disclosure describes a method of monitoring a wash system. The method may include determining, via a current sensor, that an electrical current flowing through a power cable providing electricity to the wash system that exceeds a predetermined idle value. The method may include, based on the determination that the electrical current exceeds the predetermined idle value, initiating, via a supply water flow meter, water flow readings of supply water flowing through a water supply line into the wash system. The method may also include, based on the determination that the electrical current exceeds the predetermined idle value, initiating, via one or more color sensors, color readings of one or more chemicals each disposed within respective chemical conduits that dispense the chemicals into the wash system. The method may also include, based on the determination that the electrical current exceeds the predetermined idle value, initiating, via one or more chemical flow meters, chemical flow readings of the one or more chemicals disposed within the respective chemical conduits. The method may include comparing the water flow readings with a predetermined acceptable range of water flow readings associated with the supply water, and comparing the chemical flow readings with a predetermined acceptable range of chemical flow readings associated with each of the one or more chemicals. The method may include comparing the color readings with a predetermined acceptable range of color readings associated with each of the one or more chemicals. The method may include initiating an alarm if at least one of the water flow readings, the chemical flow readings, or the color readings are not within the respective predetermined acceptable ranges of readings.

BRIEF DESCRIPTION OF THE DRAWINGS

Non-limiting and non-exhaustive embodiments are described in reference to the following drawings. In the drawings, like reference numerals refer to like parts through all the various figures unless otherwise specified.

For a better understanding of the present disclosure, a reference will be made to the following detailed description, which is to be read in association with the accompanying drawings, wherein.

DETAILED DESCRIPTION

Figure 1:
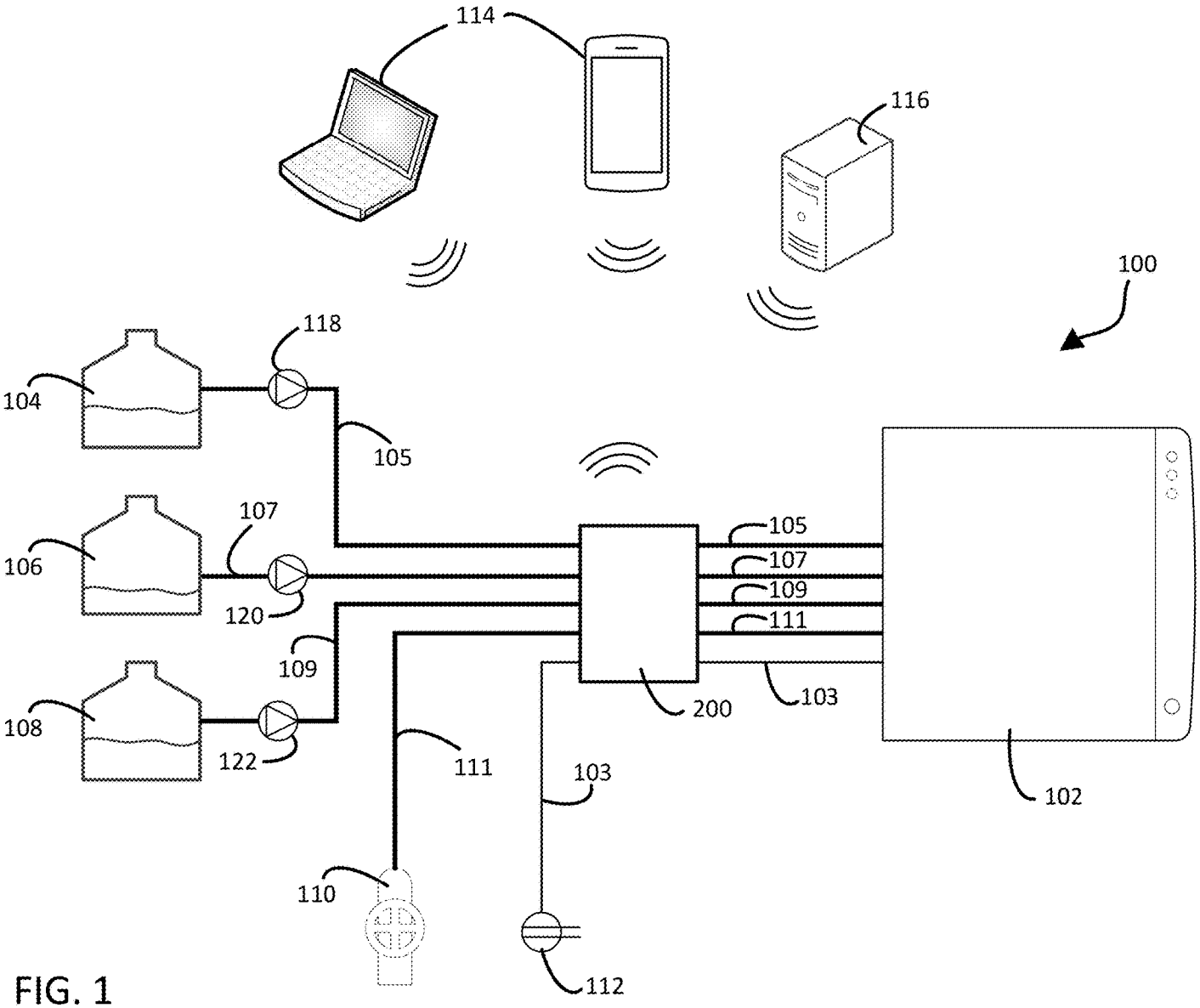
FIG. 1 is a schematic diagram of an embodiment of a dishwasher monitoring system in accordance with the disclosure.

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

The present disclosure relates to systems and methods for monitoring dishwashers and dishwashing performance. In some embodiments, the disclosure specifically relates to monitoring commercial dishwashers that may be used in commercial environments such as restaurants, cafeterias, banquet halls, schools, or other high-volume dishwashing environments. It is contemplated, however, that the methods and systems disclosed herein may also be implemented in non-commercial environments as well. It is also contemplated that other types of machine washers other than dishwashers that may use cleaning agents (e.g., soap, detergent, sanitizer, etc.) may also benefit from the teachings of this disclosure, such as laundry machines, equipment sanitizers, etc.

In some embodiments, for a dishwasher to work properly to thoroughly clean and sanitize dishware, the dishwasher may be supplied with predetermined, proper amounts of various chemicals or other cleaning agents throughout a cycle. For example, some dishwashing cycles may include at least soap, a drying agent, and chlorine being introduced to the dishwasher during a cycle in particular amounts. In some embodiments, the dishwasher may include a chemical control system that may control the supply of these liquids at the proper time during a wash cycle. If a dishwasher does not distribute the proper amounts of these chemicals during a wash cycle, the dishwasher may be operating in an "out of tolerance" condition and may not be properly cleaning or sanitizing the dishware. In some embodiments, an out of tolerance condition may occur for a variety of reasons, including but not limited to:

- The supply of detergent, sanitizer, drying agent, or other chemical may be empty;
- A chemical supply hose could may be clogged or leaking;
- A dishwasher pump may not be functioning properly;
- The incoming water supply to the dishwasher may be too hot, may be too cold, or may include insufficient volume; and/or
- One or more of the dishwasher cycles may not be running or may not be running properly.

In some cases, improper cleaning and sanitizing of dishes may lead to fines from local inspectors for violating municipal, state, or federal standards, or may lead to food poisoning, gastrointestinal issues, or other health problems for people that use dishware that has not been adequately cleaned and sanitized. Accordingly, the system and methods disclosed herein may provide practical applications of improving dishwasher cleaning and sanitizing effectiveness, improving compliance with health and safety standards, and improving health outcomes of people using dishware. The system and methods may also provide for more responsive and timely identification of dishwasher issues that may be promptly identified and remedied to minimize machine downtime. Further, by providing operators with information as to when cleaning chemicals may run low, refills may be made before the machine goes down or additional product may be obtained to further minimize machine downtime or improper cleaning.

In general the systems and methods for dishwasher monitoring disclosed herein may monitor several parameters to help confirm that a dishwasher is operating correctly. In some embodiments, the disclosed dishwasher monitoring may include keeping track of the number and length of dishwasher cycles in a given time period or since the changing of dishwashing agents to confirm whether the chemicals may need replacement or refilling. In some embodiments, the disclosed dishwasher monitoring may include monitoring incoming water temperature to confirm the water temperature is appropriate for the particular type of dishwashing (e.g., 120-200° F.) and monitoring water flow to determine that an appropriate volume of water may be used for a wash cycle. In some embodiments, if a wash cycle occurs with a water temperature that is too high or too low, proper sanitization may not take place. For example, the effectiveness of chemicals used during the wash cycle may be dependent upon the wash water temperature. Additionally, the quantity of chemicals supplied during a wash cycle may be based on the assumption of the water temperature being in a certain temperature range, and those assumptions may not hold if the water temperature is too high or too low. In some embodiments, the disclosed dishwasher monitoring may include monitoring the inventory of liquid supplies, such as chemical agents, using flow meters to determine volumes used. In some embodiments, the dishwasher monitoring may include monitoring the color of a liquid flowing through a chemical input line to verify that the proper chemical is present within each particular input line. In some embodiments, the disclosed dishwasher monitoring may include monitoring an electrical current draw related to a dishwasher pump. In some embodiments, such pump current monitoring may provide status information for a wash cycle and determine whether a dishwasher basin may be empty. In some embodiments, the disclosed dishwasher monitoring may include monitoring overall energy usage by a dishwasher that may aid in determining whether the dishwasher may be operating properly.

In some embodiments, the dishwasher monitoring system may include a dishwasher monitoring device that may include sensors, electronics, and circuitry to make various dishwasher monitoring determinations. In some embodiments, the sensors may at least include liquid flow sensors, color sensors, or temperature sensors. In some embodiments, the dishwasher monitoring device may include three chemical flow sensors (one for each type of cleaning agent), three chemical color sensors, one pump current sensor, and water temperature sensor. It is contemplated, however, that some embodiments may include other numbers or types of sensors and still operate within the scope of the systems and methods disclosed herein.

In some embodiments, the systems and methods for dishwasher monitoring may also include data collection and an alert system to identify to operators that the dishwasher may be operating improperly. In some embodiments, the alert system may include a local visual or audio alarm that may indicate a general out of tolerance condition and/or indicate the specific issue detected (e.g., low chemical agent volume, etc.). The local alarm may be at or adjacent to an area where the dishwasher and supply liquids/chemicals may installed so as to alert an operator to the out of tolerance condition. In some embodiments, the alert system may include a remote notification element that may be accessible through wired or wireless access, such as through Ethernet, WiFi, Bluetooth, radio signal, near field communications (NFC), infrared, or other suitable communication. In some embodiments, the data collection and alert notifications may be stored and accessible via a webserver over the Internet or other networks such as a local area network (LAN), wide area network (WAN), etc. In some embodiments, the data collection may be accessible to an operator or other user via a user computing device or other Internet- or network-enabled device, and may be displayed graphically, numerically, or in other suitable formats that convey the dishwasher monitoring history and/or status.

FIG. 1 illustrates a schematic representation of various components that may be included in an embodiment of a dishwasher monitoring system 100. The monitoring system 100 may include a dishwasher 102, which may be one of various suitable types of commercial or non-commercial dishwashers that may use one or more chemical agents during a wash cycle. The monitoring system 100 may include one or more liquid chemical agents or cleaning agents that may be stored in one or more respective chemical containers, such as a first container 104, a second container 106, and a third container 108. In some embodiments, more or fewer than three chemical containers may be used that may contain more or fewer than three different chemical agents. Each liquid chemical agent may be communicated to the dishwasher through one or more chemical input lines, such as the first input line 105, second input line 107, and third input line 109. Of course, in some embodiments that include more or fewer than three chemical containers, a corresponding number of input lines may be used. In some embodiments, the liquid chemical agents may be moved from the chemical containers, 104, 106, 108, through the input lines 105, 107, 109, and into the dishwasher 102 using one or more chemical pumps such as a first pump 118, a second pump 120, and a third pump 122, respectively. In some embodiments, the first, second, and third pumps 118, 120, 122 may be peristaltic pumps, but other suitable pumps may be used. The monitoring system 100 may also include at least water source 110 with corresponding supply water line 111 that may supply water to the dishwasher 102 during a dishwashing cycle or otherwise. The dishwasher 102 may include a dishwasher motor, one or more dishwasher pumps, valves, and/or other components that may be powered from a power source 112 (e.g., an electrical outlet, generator, batter, etc.) via a power cable 103. In some embodiments, the dishwasher pumps may be controlled by a dishwasher control system to convey water into and/or out of a basin of the dishwasher 102, and/or convey chemical agent into the dishwasher as appropriate for a given wash cycle.

In some embodiments, a monitoring device 200 may be disposed within the monitoring system such that the one or more chemical input lines 105, 107, 109 may fluidly communicate through the monitoring device. In some embodiments, the monitoring device 200 may be installed onto an existing dishwashing or other machine washer system to monitor the system. As described in greater detail below, that the liquid chemicals running through input lines 105, 107, 109 may be monitored by sensors within the monitoring device 200. In some embodiments, the monitoring device 200 may include network hardware that may provide wired or wireless communication between the monitoring device and one or more user computing devices 114. As described above, the communication may be via any suitable communication method, such as direct wireless communication (e.g., Bluetooth or NFC), via a WiFi or a wired router, or remote access to a web server 116 for storing data collected by the monitoring device 200. In some embodiments, a web interface providing access to the monitoring device may be hosted on the web server 116 to provide current and historic operational data. In some embodiments, the chemical input lines 105, 107, 109, the supply water line 111, and/or the power cable 103 may run through a housing of the monitoring device 200, or may alternatively run adjacent the device. In either embodiment, sensors may monitor activity in those components and communicate that activity to components of the monitoring device 200.

Monitoring Device

Figure 2:
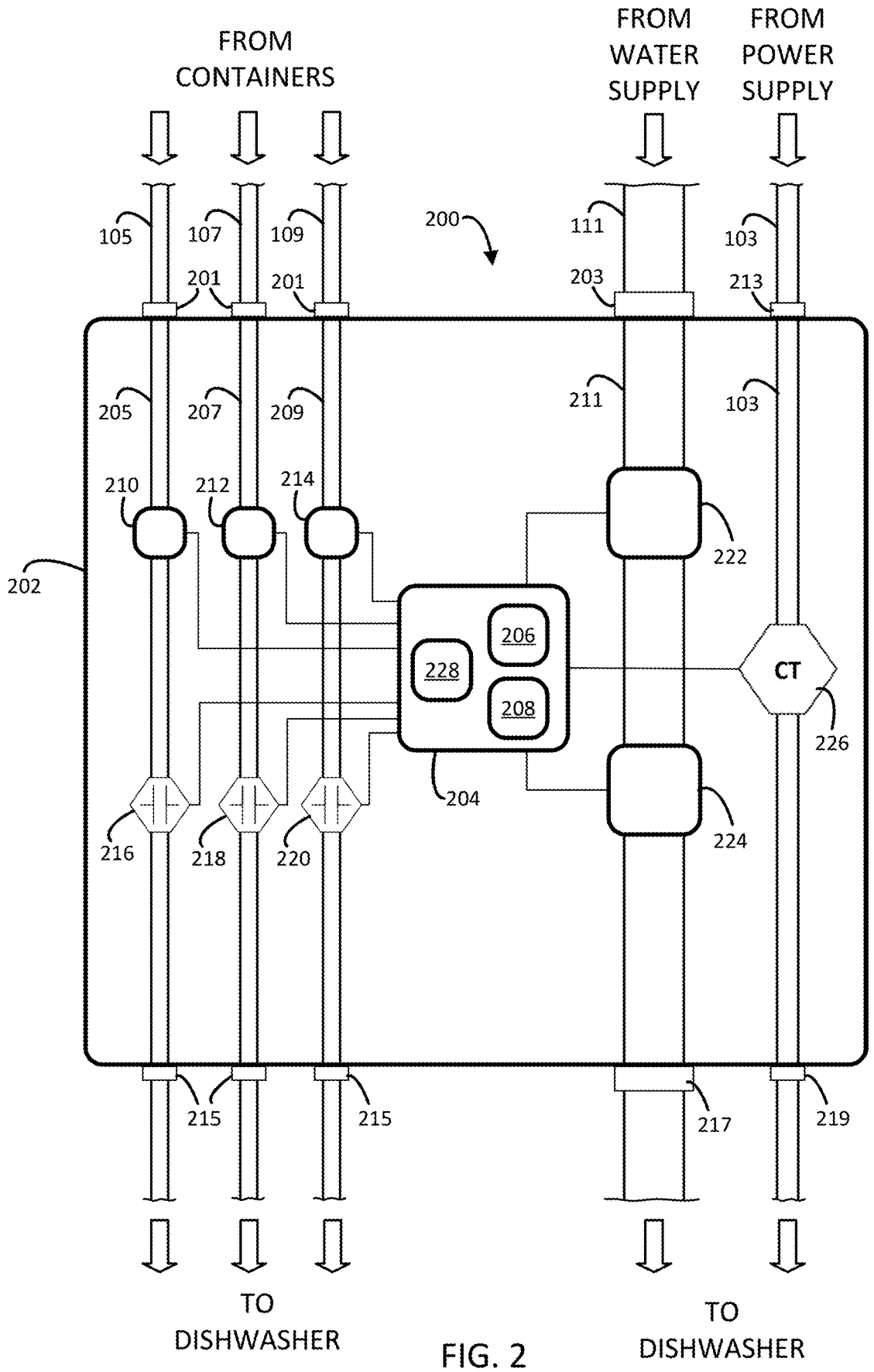
FIG. 2 is a schematic diagram of an embodiment of a monitoring device of the dishwasher monitoring system of FIG. 1.

FIG. 2 shows a schematic diagram of an embodiment of a dishwasher monitoring device 200. The monitoring device 200 may include a housing 202 that may house a controller 204 in electronic communication with a plurality of sensors. The controller 204 may be a microprocessor input/output controller including one or more processors, or any suitable controller configured to receive signals, process data, and output signals. In some embodiments, some or all of the sensors may be disposed within the housing 202. In some embodiments, some or all of the sensors may not be disposed within the housing but may communicate sensed information to the controller 204 either through wired or wireless connections. In the embodiment shown in FIG. 2, the housing 202 houses all the sensors in communication with the controller 204, but those skilled in the art will recognize that other configurations may vary without straying from the scope of the disclosure. In some embodiments, the controller 204 may include a programmable memory 228 that may contain processor-executable instructions that may cause the processor to execute particular tasks. In some embodiments, the controller 204 may include an analog-to-digital (A2D) converter 206 and a wireless antenna (208), such as a WiFi antenna or other mechanism for conveying information wirelessly. It is contemplated that, in some embodiments, the controller 204 may additionally or alternatively include an input for an Ethernet or other wired networking connection. In some embodiments, the A2D converter 206 may be a 16-bit analog to digital converter that may receive analog signals from sensors (e.g., temperature sensors, current sensors), convert those signals into digital values, and communicate those values to the controller 204 such as via an inter-integrated circuit ($I^2C$) serial bus.

The housing 202 may include one or more chemical input fittings 201 that may provide a connection point for chemical input lines 105, 107, 109 to fluidly communicate their respective chemical agents into the housing. In some embodiments, one or more chemical conduits, such as first conduit 205, second conduit 207, and third conduit 209, may correspond to the first, second, and third input lines 105, 107, 109 to provide fluid communication of the respective chemicals through the housing 202 for analysis and monitoring by various sensors. Although three chemical conduits are shown in FIG. 2, it is contemplated that any number of chemical conduits may be included within the housing 202 to correspond with the number of chemical cleaning agents or chemical input lines for a given embodiment. In some embodiments, the chemical conduits may be substantially transparent or translucent to provide for color analysis of the chemical agent within each particular conduit. In some embodiments, the housing may also include one or more chemical output fittings 215 to provide a connection point for the chemical input lines 105, 107, 109 to convey the chemical cleaning agents into the dishwasher. In some embodiments, it is contemplated that the chemical input lines 105, 107, 109 may instead pass through the housing 202 for analysis instead of using separate chemical conduits 205, 207, 209.

In some embodiments, one or more color sensors, such as a first color sensor 210, a second color sensor 212, and a third color sensor 214 may be disposed on or adjacent each of the one or more chemical conduits 205, 207, 209. In some embodiments, the first, second, and third color sensors 210, 212, 214, may correspond to the first, second, and third chemical conduits 205, 207, 209. More or fewer color sensors may be used in varying embodiments depending on the number of chemical cleaning agents used. In some embodiments, each of the one or more chemical cleaning agents may be a different color providing for easy visual determination of the identities of each respective chemical. In some jurisdictions, local or national codes or standards may require particular chemicals to be particular colors. For example but without limitation, in some embodiments, a detergent (i.e., soap) may be red in color, a sanitizer may be yellow in color, and a drying agent may be blue in color. It should be understood that different jurisdictions may use alternative color schemes, but for the sake of illustration and clarity this disclosure will refer to the color scheme described above.

In some embodiments, the color sensors 210, 212, 214 may be configured to determine or to aid the controller 204 in determining the color of the chemical liquid flowing within a particular transparent or translucent chemical conduit. In some embodiments, each color sensor may include photodiodes configured to sense one or more particular colors. In some embodiments, the data from the photodiodes may be communicated to the controller 204 via wired or wireless connections. In some embodiments, the color sensor data may be communicated via a 1-wire serial bus, such as an $I^2C$ serial bus. The color sensor data may be received at the controller 204, for example, as a numerical value pertaining to the particular colors sensed by the photodiodes. For example, in embodiments where the color sensors may include red, green, and blue (R, G, B) and clear sending photodiodes, the color sensing data received by the controller 204 from each color sensor may be received as a tuple of RGB (#, #, #), with different values depending on the detected color of each color in a particular conduit. The data from the color sensor may then be evaluated by the controller 204 based on the particular chemical conduit that the color sensor may be monitoring. In some embodiments, the first chemical conduit 205 may contain sanitizer (yellow), the second chemical conduit 207 may contain detergent (red), and the third chemical conduit 209 may contain drying agent (blue). In such an embodiment, when the controller 204 receives data from the third color sensor 214 monitoring the color of liquid within the third chemical conduit 209, the third value in the tuple (pertaining to "blue") may be greater than the first and second values. Such a result may provide a reasonable certainty that a blue liquid is within the third conduit 209, thus confirming that the drying agent is correctly present. In some embodiments, a similar process may be take place with respect to chemical agents that may be expected to be other colors, such as red or yellow.

In some embodiments, one or more chemical flow meters, such as a first flow meter 216, a second flow meter 218, and a third flow meter 220, may be disposed on or adjacent each of the one or more chemical conduits 205, 207, 209. In some embodiments, the first, second, and third flow meters 216, 218, 220, may correspond to the first, second, and third chemical conduits 205, 207, 209. More or fewer flow meters may be used in varying embodiments depending on the number of chemical cleaning agents used. In some embodiments, the flow meters may be hall-effect paddle-wheel flow meters that may generate a pulse train output signal that may be proportional to the flow within a particular chemical conduit. The output signal from each flow meter may be communicated as an input to the controller 204 to determine a measurement of the chemical flow in each particular chemical conduit. In some embodiments, the flow meters may provide flow verification, flow volume totalization, or both. When a pulse from one of the flow meters 216, 218, 220 is received by the controller 204 at a point in a wash cycle when the chemical from that particular conduit is supposed to be dispensed, this may provide verification that the particular chemical was, in fact, dispensed as intended.

In some embodiments, through monitoring the flow rates of each chemical agent through the chemical conduits 205, 207, 209, the monitoring device 200 may perform flow totalization to measure and track the volume of each chemical agent that has been dispensed. By measuring the volume, the monitoring device 200 may confirm whether a proper amount of chemical has been dispensed during a wash cycle that may ensure proper cleaning and sanitation. Flow totalization may also enable the monitoring device 200 to monitor chemical inventory for each of the chemical agents, which may enable the monitoring device to predict when a particular chemical agent may run out and need to be refilled. In some embodiments, the controller 204 may provide an alarm to alert operators that a chemical may need to be refilled to maintain proper dishwasher function. For example, if a chemical container 104 contains 128 ounces of a chemical when full, the controller 204 may perform flow totalization during wash cycles to determine when the 128 ounces has nearly been spent. In some embodiments, the monitoring device 200 may include a user input that may notify the device to restart a flow totalization count because a particular chemical container may have been refilled or replaced. The user input may be physically on the device in some embodiments, or may be accessible remotely via a user computing device. In some embodiments, the user may input the volume of the container being introduced or refilled, or input a preference for alert notifications, such as when the container is ¼ full, ⅛ full, etc.

In some embodiments, the power cable 103 providing electricity to the dishwasher 102 and its components may be disposed in or adjacent to the housing 202. In some embodiments, the housing 202 may include a first cable orifice 213 and a second cable orifice 219 that may allow the power cable 103 pass through the housing for monitoring and continue on to the dishwasher 102. In some embodiments, it is contemplated that the power cable 103 may not pass through the housing 202 but may nevertheless be monitored by sensors that may communicate with the controller 204. In some embodiments, a current sensor 226 may be disposed on or adjacent to the power cable, either within the housing 202 or otherwise. In some embodiments, the current sensor 226 may include a precision, low-offset linear Hall sensor circuit with a copper current path near a wafer. In some embodiments, a current applied through the copper current path may generate a magnetic field that can be induced by the Hall integrated circuit (IC) and may be converted to a proportional voltage. In some embodiments, the analog voltage may be converted to other units, such as engineering units, using the A2D converter 206, and communicated to the controller 204. Of course, those of skill in the art will recognize that other types of current sensors may be used to sense or detect the current flowing through the power cable consistent with the disclosure.

In some embodiments, the current sensor 226 may be used to detect various operations of the dishwasher 102 and its components. For example, the current sensor 226 may help detect that a wash cycle may be starting, determine wash stage progress, determine that the dishwasher pumps are drawing current as expected for proper operation, and/or to determine whether other dishwasher problems exist. In some embodiments, the current sensor 226 may detect that the current in the power cable 103 being drawn by the dishwasher 102 may exceed a predetermined idle value, which may indicate that a wash cycle has begun. Throughout a wash cycle, the level of current drawn by the dishwasher and detected by the current sensor 226 may be used to monitor the stages of the wash cycle because motors or pumps may draw predetermined levels of power based for each stage. In some embodiments, the monitoring device 200 may detect whether a dishwasher pump, such as a centrifugal pump, may be drawing its motor's full load amps (FLA). In some embodiments, when a centrifugal pump in a dishwasher is actually moving water (e.g., pumping water out of the dishwasher basin), the motor powering that pump may draw the motor's FLA, which may be a predetermined current. When the pump runs dry, the same motor may only draw a fraction of the FLA, which may be detected by the current sensor 226 and communicated to the controller 204. In some embodiments, if such a motor fails to reach a value near the FLA, the controller 204 may determine that the basin may not be draining properly because, for example, a basin strainer may be clogged. Alternatively, if the current sensor 226 detects that the current drawn by the centrifugal pump motor may be near the FLA for a predetermined, programmable period of time, and then the current drops to a fraction of the FLA before turning off, the controller 204 may determine that a dishwasher basin may have been properly emptied of dirty water at the conclusion of a cycle. In such embodiments, the controller 204 may thus determine the start and end of a wash cycle by monitoring current through the power cable 103 using the current sensor 226. It is also contemplated that other programmable current states may be detected by the current sensor 226 and the controller 204 consistent with the scope of this disclosure.

In some embodiments, the housing 202 may also include a supply water input fitting 203, a supply water conduit 211 running through or adjacent the housing, and/or a supply water output fitting 217. The supply water input fitting 203 may provide a connection point for the supply water line 111 to fluidly communicate supply water into the supply water conduit 211 for monitoring by the monitoring device 200. The supply water output fitting 217 may provide a connection point to fluidly communicate the supply water out of the housing 202 and back into the supply water line 111 to flow into the dishwasher as appropriate. In some embodiments, the supply water line 111 may instead run adjacent to the housing 202, and sensors may be disposed on the supply water line 111 itself and configured to electrically communicate signals back to the controller 204. Additionally, in some embodiments, the supply water line 111 itself may run through the housing 202 through orifices on either end of the housing.

In some embodiments, a water flow meter 222 and a water temperature sensor 224 may be disposed on the supply water conduit 211 (or the supply water line 111 in some embodiments) to monitor the flow and temperature of the supply water entering the dishwasher 102 during a wash cycle. In some embodiments, maintain water temperature within a proper temperature range may be important for thorough sanitation. In some embodiments, the temperature sensor 224 may be an analog temperature sensor that may provide an analog voltage that may be proportional to the supply water temperature. The analog voltage may be communicated to the A2D converter for conversion and scaling as appropriate for the controller 204 to analyze. In some embodiments, it is contemplated that other types of temperature sensors may be used to detect and communicate the supply water temperature to the controller 204. In some embodiments, the incoming supply water temperature may be recorded by the controller 204 periodically throughout a duration of a wash cycle (e.g., every 1 second, every 2 seconds, every 5 seconds, etc.). In some embodiments, the recorded water temperatures may be averaged or otherwise processed, and compared against a predetermined programmable acceptable temperature value to verify proper water temperatures for the wash cycle.

In some embodiments, the water flow through the supply water conduit 211 (or the supply water line 111) may be periodically detected by the water flow meter 222 and communicated to the controller 204 for analysis. In some embodiments, the water flow meter 222 may be hall-effect paddle-wheel flow meter that may generate a pulse train output signal that may be proportional to the water flow within a the supply water conduit (or the supply water line 111). By comparing water flow rates over the time duration of the wash cycle, the controller 204 may determine the volume of water used by the dishwasher 102 during a wash cycle. In some embodiments, the amount of water used may be compared with a predetermined, programmable water input volume to verify that a proper amount of water was used during the wash cycle.

Error Identification

In some embodiments, the monitoring device 200 may identify a variety of error states related to the operation of a dishwasher 102 or other machine washer. As described above, these errors may be communicated in any of a variety of ways, such as via a visual or auditory alarm disposed near the dishwasher 102, or remotely to a user computing device 114 or web server 116 for user access. In some embodiments, an alarm may be triggered on an interface box or annunciator panel of the dishwasher, indicating to an operator that a problem may need attention or service should be ordered. In some embodiments, a user computing device 114 may receive a notification triggered by the monitoring device 200, such as via a software application running on the computing device, or via the computing device's native notification system. In some embodiments, the web server 116 that may receive data from the monitoring device 200 may initiate a notification to particular users, such as via email or other notifications delivered via a user computing device associated with particular users.

In some embodiments, a user may log onto the web server 116 to see historic data related to the monitoring of one or more dishwashers 102 or other machine washers. In some embodiments, it is contemplated that a health inspector or other regulator may be granted access to historical data collected by the monitoring device 200. By reviewing the historic data related to dishwasher or other machine washer's operation, the inspector may determine whether a restaurant or other commercial establishment has been operating its machines up to codes or other standards. In some embodiments, a business owner or manager may remotely monitor error identification and other machine washer operation to determine whether employees or other operators may be properly operating one or more machines, or to determine whether service should be called, or whether additional washing products should be purchased. Those skilled in the art may identify many other uses for an error identification system such as that disclosed herein relating to the errors detected by the monitoring device 200.

The following describes a non-limiting example of a set of potential system errors that may be identified by the monitoring device 200 and trigger alerts or notifications. In some embodiments, the monitoring device 200 may determine that a particular chemical agent may not be flowing. This type of error may be identified via one or more of the flow meters 216, 218, 220 disposed on the first, second, and third chemical conduits 205, 207, 209, respectively. For example, if no flow signal is received from the first flow meter 216, the controller 204 may determine that no chemical agent is flowing through the first chemical conduit 205, and thus that particular chemical agent is not being introduced into the dishwasher 102. If the controller 204 determines that this particular chemical agent is supposed to be flowing at the time no flow is detected, an error may be triggered. In some embodiments, no flow detected in such a scenario may indicate such problems as a broken first input line 105, an empty first container 104, or an problem related to a pump configured to pump the chemical agent through the first input line and into the dishwasher 102. In some embodiments, the monitoring device 200 may determine that a particular chemical container, such as first container 104, may be empty if no flow is detected in a corresponding first chemical conduit 205 and the volume of chemical used through totalizing flow detection has met or exceeded a predetermined, programmable chemical volume without any user input that the first container 104 has been changed or refilled.

In some embodiments, the monitoring device 200 may determine that the incorrect chemical agent may be running through a particular chemical conduit. For example, if a yellow chemical (e.g., sanitizer) is supposed to be running in the second conduit 207 but the controller 204 determines based on color sensor 212 that the chemical that is actually running through the second conduit is not yellow (e.g., blue), the monitoring device 200 may trigger an alert indicating as much. In some embodiments, this type of error may be generated based on flow totalization. For example, if 128 ounces of a chemical has been dispensed since the monitoring device 200 has received an input indicating that a 128 ounce chemical container has been refilled or replaced, the monitoring device may determine that no chemical agent may remain to be dispensed.

In some embodiments, the monitoring device 200 may determine via temperature sensor 224 that the incoming supply water temperature may be higher or lower than a predetermined, programmable acceptable temperature or temperature range. For example, in some embodiments, an acceptable supply water temperature range may be between about 110 and about 140 degrees Fahrenheit. In such embodiments, if the temperature detected by the water temperature sensor 224 is greater than the predetermined acceptable temperature range, the monitoring device 200 may trigger a high temperature alert. Similarly, if the temperature detected by the water temperature sensor 224 is less than the predetermined acceptable temperature range, the monitoring device 200 may trigger a low temperature alert.

In some embodiments, the monitoring device 200 may determine via water flow meter 222 that the total volume of water supplied to the dishwasher 102 during a wash cycle may be higher or lower than a predetermined, programmable acceptable volume or volume range. For example, in some embodiments, an acceptable incoming supply water volume range may be between about 16 fluid ounces and about 18 fluid ounces. In such embodiments, if the supply water volume detected by the water flow meter 222 is greater than the predetermined acceptable volume range, the monitoring device 200 may trigger a high water volume alert. Similarly, if the supply water volume detected by the water flow meter 222 is less than the predetermined acceptable volume range, the monitoring device 200 may trigger a low water volume alert. In some embodiments, similar high or low volume alerts may be triggered with respect to detected volumes of chemical agents that may be higher or lower than predetermined acceptable volume levels for each particular chemical agent.

In some embodiments, the monitoring device 200 may determine that water may not be draining out of the dishwasher 102 basin even though a dishwasher pump may be operating properly. In such embodiments, a drain failure alert may be triggered based on detecting the current through the power cable 103 to the dishwasher 102 with the current sensor 226. If the controller 204 does not detect a current value at or near FLA for the dishwasher pump to empty the basin followed by a fractional value of FLA at the conclusion of a wash cycle, the controller 204 may determine that the water discharge from the basin may be incomplete. Such a scenario may occur if the pump may be operating properly but not configured to run long enough to discharge all the water. In some embodiments, such an error state may indicate that the pump may not be operating properly.

In some embodiments, using readings detected by the current sensor 226, the controller 204 may determine whether the dishwasher has completed a predetermined, programmable number of acceptable cycles or stages during a wash cycle. Because the controller 204 may determine when a wash cycle may begin and end based on current draw, and may determine stages of a wash cycle by detecting current draw by the motor at various wash stages, the controller may determine whether the dishwasher has completed the acceptable number of wash cycles. In some embodiments, the monitoring device 200 may also determine whether a dishwasher motor may be functioning properly based on either data from the current sensor 226 and/or the water flow meter 222. In some embodiments, if the monitoring device 200 may not be transmitting data or may not be accessible via a web interface on the web server 116, this may indicate that the dishwasher 102 is not receiving any power.

Figure 3:
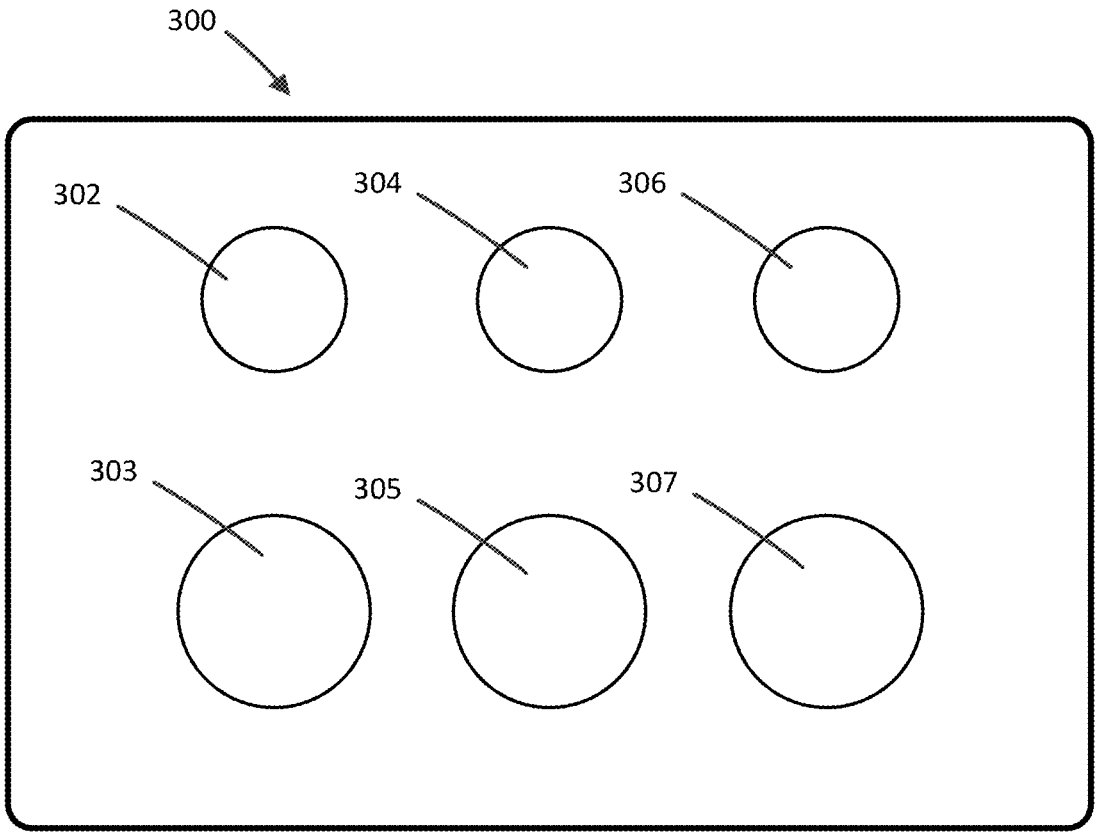
FIG. 3 is a schematic diagram of an interface box in accordance with the disclosure.

In some embodiments, the monitoring system 100 may include an interface box or panel that may provide visual or audio alerts to operators and may receive operator inputs. FIG. 3 shows an embodiment of an interface box 300 that may be disposed on or near the monitoring device 200, or may be disposed in another accessible location for easy access by an operator, such as on a front or top of a dishwasher or other machine washer. In some embodiments, the interface box 300 may include one or more indicator lights and one or more inputs. The interface box 300 in FIG. 3 includes a first indicator light 302, a second indicator light 304, and a third indicator light 306. In some embodiments, the interface box 300 may include a first input 303, a second input 305, and a third input 307. Although interface box 300 includes three indicator lights and three inputs, it is contemplated that more or fewer indicator lights and/or inputs may be used in other embodiments.

In some embodiments, the number of indicator lights and inputs may correspond to the number of different chemical agents used for a particular machine washer or a particular type of wash cycle. For example, in some embodiments, the first indicator light 302 and first input 303 may correspond to a chemical agent from the first container 104, the second indicator light 304 and second input 305 may correspond to a chemical agent from the second container 106, and the third indicator light 306 and third input 307 may correspond to a chemical agent in the third container 108. In some embodiments, when the indicator light for a corresponding chemical in a particular chemical container illuminates, the interface box 300 may be signaling that there may be an error related to the corresponding chemical agent. For example, if the chemical agent in the first container 104 may be running low or has run out as detected by the monitoring device 200, the first indicator light 302 may illuminate, and an accompanying audio alert may sound from the interface box 300 to draw further attention to the error. An operator may then investigate and troubleshoot the problem. In instances where the chemical has run low or needs to be replaced or refilled, the operator may press the first input 303 once the first container 104 is refilled, which may signal the controller 204 to reset its flow totalization count for chemical volume. In some embodiments, the indicator lights 302, 304, 306 may be colored to correspond with the colors of the chemical agents to which they correspond. For example, in some embodiments, a detergent may be red and come from the first container 104, a sanitizer may be yellow and come from the second container 106, and a drying agent may be blue and come from the third container 108. In such embodiments, the first indicator light 302 may be colored red to match the red detergent, the second indicator light 304 may be colored yellow to match the yellow sanitizer, and the third indicator light 306 may be blue to match the blue drying agent. Of course, those skilled in the art will recognize that differing colors may be used for different embodiments that may use differing chemical agents and/or colors.

Controller Logic

Figure 4:
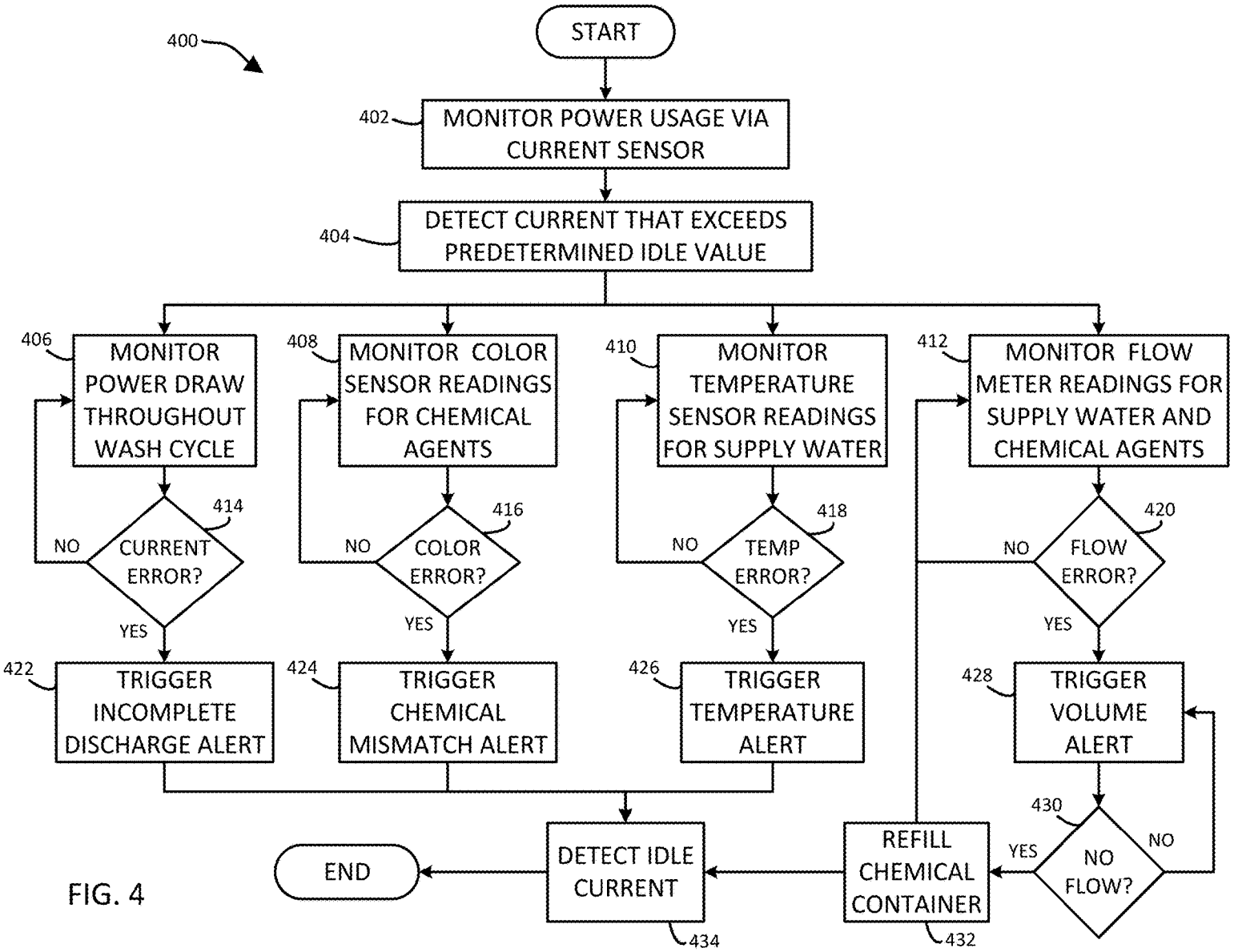
FIG. 4 is a flow chart of an embodiment of a method for monitoring a wash system in accordance with the disclosure.

The controller 204 of the monitoring device 200 may detect out of tolerance conditions in a variety of ways using the color sensors, flow meters, temperature sensors, current sensors, and combinations thereof. In some embodiments, depending on particular conditions detected, the controller 204 may make more specific determinations regarding the particular problem with the system 100 that may have precipitated the error. FIG. 4 is a flow chart of an embodiment of a method 400 of monitoring a dishwasher or other machine washer. In some embodiments, the method may be carried out using a monitoring device such as the monitoring device 200 described herein.

At 402, the method 400 may include monitoring power usage of the dishwasher 102 using a current sensor. At 404, the method 400 may include detecting that a current running through a power cable 103 providing power to the dishwasher and its components may has exceeded a predetermined idle value. In some embodiments, detecting a current draw in excess of the idle value may indicate that wash pumps may have been started and that a wash cycle has begun. In some embodiments, the method may include identifying chemical flow through one or more chemical conduits to determine that a wash cycle has begun and that other sensors may begin providing readings. In some embodiments, sensors may provide constant readings regardless of wash cycle status. In some embodiments, detecting that the current exceeds a predetermined idle value may trigger an initiation of color sensor readings, temperature sensor readings, flow meter readings, and continued current sensor readings. At 406, the method may include monitoring a power draw from the dishwasher via the current sensor through the wash cycle. In some embodiments, such monitoring may be used to monitor the wash stage progress. In some embodiments, the motor current may be monitored to verify complete discharge of water from the dishwasher basin. At 414, the method may include determining whether a current error has occurred. In some embodiments, determining a current error may include determining whether a water discharge pump draws a current value near the pump's FLA and then drops down to a fractional value of the FLA. If yes, the pump may be cavitating, indicating that all of the water has been discharged. If the current value does not drop down before the pump shuts off, an issue during water discharge may have occurred. Additionally, an error may have occurred if the pump never draws near the FLA during the cycle. At 422, the method may include triggering a discharge error alert if one of the above errors may have been detected.

At 408, the method 400 may include monitoring color sensor readings for the chemical agents flowing through each chemical conduit with a color sensor. In some embodiments, this may be initiated by turning on a backlight for the color sensors and reading data (e.g., RGB values) received from the color sensors. At 416, the method may include determining whether a color error has occurred. In some embodiments, this determination may be made by evaluating color values against a predefined values for the correct color for each chemical that is supposed to be running through a particular conduit. In some embodiments, the predefined values for the colors in each particular chemical conduit may be different, indicating that different color chemical agents should be disposed within the different respective chemical conduits. In some embodiments, if the color values are within a predetermined percentage deviation from the predefined values for each color, it may be determined that the correct chemicals may be flowing in the correct chemical conduits. If the color values are not within the predetermined percentage deviation from the predefined values for each color, then, at 424, a chemical mismatch alert may be triggered to indicate that the wrong chemical agent may be flowing in a particular chemical conduit.

At 410, the method may include monitoring temperature sensor readings for the supply water. In some embodiments, the temperature sensor may monitor the incoming water temperature as long as the incoming water flow meter indicates water flow. In some embodiments, an average of the periodically-taken temperature sensor readings may be calculated. At 418, the method may include determining whether a temperature error may have occurred. In some embodiments, this may include determining if the average water temperature of the total water volume introduced to the dishwasher during a wash cycle is within a predetermined acceptable temperature range. If yes, no alarm is set. If no, at 426, a temperature alert may be triggered indicating that the wash cycle may not have been conducted at the proper water temperature.

At 412, the method may include monitoring flow meter readings for the supply water and the chemical agents via the water flow meter and the chemical flow meters. In some embodiments, the flow meters may monitor the chemical agent and incoming water flow and determine a total volume of each for each cycle. In some embodiments, the flow meter readings may also be used to determine wash cycle progress when particular predetermined flow rates and or volumes used may indicate wash cycle stages or progress. At 420, the method may include determining whether a flow error may have occurred. In some embodiments, this may include determining whether all the flow meters have accumulated a total volume that may be within a predetermined acceptable volume range for the correct amount of water to be used during a wash cycle and the correct amount of each particular chemical agent used during a wash cycle. If yes to both, then no chemical or water alert will be triggered. In some embodiments, this volume data may be used to monitor chemical agent inventory over multiple wash cycles to determine whether a chemical container may need refilling or replacement. If the volume for either the chemical agent or the supply water is determined to not be within the predetermined acceptable ranges, then, at 428, the method may include triggering a volume alert relating to one or more chemical agents, the flow water, or both. In some embodiments, the method may include, at 430, further determining whether no flow has been detected in the particular chemical conduit that may have triggered an alert. If yes, then this may indicate that the chemical container may be empty and need to be replaced or refilled.

At 434, the method may include detecting that the current drawn by the dishwasher may have dropped back to the predetermined idle value. In some embodiments, such a determination may indicate that the wash cycle may be complete, and the various sensors may cease monitoring until another wash cycle begins. In some embodiments, determining that wash cycle has completed may additionally or alternatively include determining that a predetermined wash duration time period has passed since the wash cycle began. In some embodiments, this predetermined wash duration may be adjustable and/or defined during installation of a monitoring device.

The foregoing description and drawings merely explain and illustrate the invention and the invention is not limited thereto. While the specification is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements which, although not explicitly described or shown herein, embody the principles of the invention and, thus, within its scope and spirit.

Throughout the specification and claims, the following terms take the meanings explicitly associated herein, unless the context clearly dictates otherwise. The phrase "in one embodiment" as used herein does not necessarily refer to the same embodiment, although it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and includes plural references. The meaning of "in" includes "in" and "on."

What is claimed is:

1. A wash-quality monitoring system comprising:

a housing;

one or more processors housed within the housing;

a supply water flow meter configured to be disposed in a supply water line of a wash system, the supply water flow meter being in communication with the one or more processors and configured to transmit, to the one or more processors, water flow readings of water flow through the supply water line;

one or more chemical conduits disposed within the housing, the one or more chemical conduits each including a chemical input providing fluid communication into the housing and a chemical output providing fluid communication out of the housing;

at least one color sensor disposed on each of the one or more chemical conduits, each of the at least one color sensor being in communication with the one or more processors and configured to transmit, to the one or more processors, color readings of a chemical disposed within each of the respective one or more chemical conduits;

at least one chemical flow meter disposed on each of the one or more chemical conduits, each of the at least one chemical flow meter being in communication with the one or more processors and configured to transmit, to the one or more processors, chemical flow readings of chemical flow through each of the respective one or more chemical conduits;

a current sensor in communication with the one or more processors, the current sensor being disposed on a power cable providing power to the wash system and transmitting, to the one or more processors, current readings of an electrical current flowing through the power cable; and a memory containing processor-executable instructions that, when executed by the one or more processors, cause the one or more processors to:

determine that a new wash cycle has begun based on a determination that the current running through the power cable exceeds a predetermined idle value, compare the water flow readings with a predetermined acceptable range of water flow readings associated with the supply water line, in response to the determination that the new wash cycle has begun, compare the chemical flow readings with a predetermined acceptable range of chemical flow readings associated with each of the one or more chemical conduits and compare the color readings with a predetermined acceptable range of color readings associated with each of the one or more chemical conduits, and initiate an alarm if at least one of the water flow readings, the chemical flow readings, or the color readings are not within the respective predetermined acceptable ranges of readings.

2. The system of claim 1 further comprising a water temperature sensor disposed on the supply water line and configured to transmit, to the one or more processors, water temperature readings of water flowing through the supply water line.

3. The system of claim 2, wherein the processor-executable instructions further cause the one or more processors to:

compare the water temperature readings with a predetermined acceptable range of water temperature readings associated with the supply water line; and initiate an alarm if the water temperature readings are not within the predetermined acceptable ranges of water temperature readings.

4. The system of claim 1 further comprising a current sensor in communication with the one or more processors, the current sensor being configured to transmit current readings associated with the wash system.

5. The system of claim 1, wherein:

a first color sensor of the at least one color sensor is disposed on a first chemical conduit of the one or more chemical conduits;

a second color sensor of the at least one color sensor is disposed on a second chemical conduit of the one or more chemical conduits;

a third color sensor of the at least one color sensor is disposed on a third chemical conduit of the one or more chemical conduits; and wherein each of the predetermined acceptable range of color readings associated with each of the first, second, and third chemical conduits are different.

6. The system of claim 1, wherein the processor-executable instructions further cause the one or more processors to determine, based on the current readings, that water has not been properly discharged from the wash system at an end of a wash cycle by:

determining, for a first time period, that the current readings for current drawn by a water discharge pump of the wash system match a full load amps (FLA) value; and determining, for a second time period subsequent to the first time period, that the current readings for the current drawn by the water discharge pump of the wash system match a cavitation value that is less than the FLA value.

7. A wash monitoring device comprising:

a housing;

a controller housed within the housing, the controller including a memory and one or more processors;

one or more chemical conduits disposed within the housing, each of the one or more chemical conduits providing fluid communication into and out of the housing;

a chemical flow meter disposed on each of the one or more chemical conduits, each of the chemical flow meters being in communication with the controller and configured to transmit, to the controller, chemical flow readings of chemical flow through each of the respective one or more chemical conduits; and a current sensor disposed on a power cable providing power to a wash system, the current sensor being in communication with the controller and transmitting, to the controller, current readings of an electrical current flowing through the power cable;

wherein the memory contains processor-executable instructions that, when executed by the one or more processors, cause the one or more processors to:

determine that the wash system has initiated a wash cycle based on a determination that the current running through the power cable exceeds a predetermined idle value, in response to determining that the wash system has initiated a wash cycle, compare the chemical flow readings with a predetermined acceptable range of chemical flow readings associated with each of the one or more chemical conduits, compare the current readings of the electrical current flowing through the power cable to a predetermined acceptable range of current values drawn by a water discharge pump of the wash system to determine whether water has been properly discharged from the wash system at an end of a wash cycle, and initiate an alarm if at least one of the chemical flow readings or the current readings are not within the respective predetermined acceptable ranges of readings.

8. The device of claim 7 further comprising a water temperature sensor disposed on a supply water line of the wash system and configured to transmit, to the controller, water temperature readings of water flowing through the supply water line.

9. The device of claim 8, wherein the processor-executable instructions further cause the one or more processors to:

compare the water temperature readings with a predetermined acceptable range of water temperature readings associated with the supply water line; and initiate an alarm if the water temperature readings are not within the predetermined acceptable ranges of water temperature readings.

10. The device of claim 9 further comprising a supply water flow meter configured to be disposed in a supply water line of the wash system, the supply water flow meter being in communication with the controller and configured to transmit, to the controller, water flow readings of water flow through the supply water line, wherein the processor-executable instructions further cause the one or more processors to:

compare the water flow readings with a predetermined acceptable range of water flow readings associated with the supply water line, and initiate an alarm if the water flow readings are not within the respective predetermined acceptable ranges of readings.

11. The device of claim 7 further comprising:

a color sensor disposed on each of the one or more chemical conduits, each of the color sensors being in communication with the controller and configured to transmit, to the controller, color readings of a chemical disposed within each of the respective one or more chemical conduits; and wherein the memory further contains processor-executable instructions that, when executed by the one or more processors, cause the one or more processors to:

compare the color readings with a predetermined acceptable range of color readings associated with each of the one or more chemical conduits, and initiate an alarm if at least one of the color readings are not within the respective predetermined acceptable ranges of readings.

12. The device of claim 7, wherein determining whether water has been properly discharged from the wash system at an end of the wash cycle includes:

determining, for a first time period, that the current readings for current drawn by a pump of the wash system match a full load amps (FLA) value; and determining, for a second time period subsequent to the first time period, that the current readings for the current drawn by the pump of the wash system match a cavitation value that is less than the FLA value.

* * * * *